United States Patent [19]

Finke et al.

[11] Patent Number: 4,591,050

[45] Date of Patent: May 27, 1986

[54] TWO-COMPONENT PACKAGE

[75] Inventors: Robert-Günter Finke, Finnentrop; Clemens Schumacher, Sundern; Albert Kolb, Darmstadt-Eberstadt; Horst Lautenschläger, Modautal; Jürgen Konetzka, Darmstadt-Eberstadt, all of Fed. Rep. of Germany

[73] Assignee: Robert Finke Kommanditgesellschaft, Finnentrop, Fed. Rep. of Germany

[21] Appl. No.: 634,904

[22] Filed: Jul. 26, 1984

[30] Foreign Application Priority Data

Jul. 30, 1983 [DE] Fed. Rep. of Germany ..... 3327615

[51] Int. Cl.[4] ..... B65D 25/08; B65D 1/04

[52] U.S. Cl. ..... 206/222; 215/DIG. 8

[58] Field of Search ..... 206/222, 219; 215/DIG. 8

[56] References Cited

U.S. PATENT DOCUMENTS 3,613,955 10/1971 Wetherell, Jr. ..... 206/222
4,132,308 1/1979 Goncalves ..... 206/219
4,294,351 10/1981 Cheetham ..... 206/222
4,513,861 4/1985 Barry ..... 206/219

FOREIGN PATENT DOCUMENTS 1557521 12/1979 United Kingdom .
1083355 9/1967 United Kingdom .

*Primary Examiner*—Joseph Man-Fu Moy
*Attorney, Agent, or Firm*—Martin A. Farber

[57] ABSTRACT

A two-component package comprises a cup arranged in a neck of the package to receive one component, and a screw cap. The cup defines an intended break line and cooperates with the neck of the package. A collar which extends into the cup, defines an abutment edge at the front end thereof. The abutment edge is disposed for separating the cup in the region of said break line upon a screwing of the cap.

The cup defines a cup wall and an annular step therein.

The step includes the break line spaced above the bottom of the cup.

An inner surface of the cup wall has a bead inwardly directed therefrom. The bead disposed above the annular step engages against an outer surface of the collar.

13 Claims, 9 Drawing Figures

TWO-COMPONENT PACKAGE

FIELD AND BACKGROUND OF THE INVENTION

The invention refers to a two-component package having a cup, arranged in the neck of the package, to receive a first component and a screw cap which is associated with the neck of the package and has a collar which extends into the cup, the front edge of said collar forming an abutment edge for the separating of the cup in the region of an intended break line upon the screwing of the screw cap beyond a basic sales position.

A two-component package of this type is known from British Patent No. 1 083 335. The cylindrical collar which is formed centrally on the cover of the screw cap, and the bottom of the cup which extends in front thereof form the actual receiving chamber for the one component. The intended-break line lies in the region of the bottom edge. In the basic sales position, the front edge is located there. In accordance with the embodiment which is described by way of example, the one component is a powder. The sealing conditions between cup and collar take this suitably into account. Such a package is therefore less suitable for liquid components; for instance, due to the capillary action in the seam between cup and neck a substantial portion of the mixture would be removed. In addition, there are disadvantages also from a structural standpoint, inasmuch as a seal-closure adapted to the conditions of fluids makes the attachment of the cover difficult as a result of the compressing of the enclosed air. Finally, there is also a disadvantage with respect to the discharge of the mixture, inasmuch as the bottom, which is developed as a disk, may possibly place itself in blocking fashion in front of the discharge opening. Finally, the required intended-break line at the height of the bottom can be produced in practice only in a manner which is expensive with respect to tooling. Even slight deviations in tolerance can lead to the bottom being separated already upon the placing on of the screw cap, due to the lack of any perceptible resistance. The content of the package may in this way become unusable without this being noted. On the other hand, too hard a threshold of response is disadvantageous for use insofar as unusual screwing forces must be applied. In this way, there may result merely a slight bulging out of the bottom rather than the desired separation.

The object of the present invention is to develop a two-component package of this type in such a manner that, while being easy to manufacture, an arrangement is created which is more favorable for use with respect to the separation.

SUMMARY OF THE INVENTION

According to the invention there is provided a two-component package wherein an abutment edge (e.g. 9') of the collar (9) is located on a line with an annular step (A) of the wall (W) of the cup, which annular step (A), which forms the intended break line, is arranged with spacing (Y) above the bottom (2') of the cup and the annular step lies underneath a bead (14), the bead engaging against the outer surface of the collar (9), the bead projecting inwardly from the inner surface of the cup wall (W).

The subordinate claims set forth further advantageous.

As a result of this development a two-component package of particularly high value in use is obtained: Due to the fact that the intended break line is now arranged at a distance from the bottom of the cup, the collar no longer exerts a piston-like compressing action; rather, the collar extends only a very short distance within the cup. This has substantial advantages, particularly also for automatic filling. Since the place of intended break is formed by an annular step on the cylinderical wall of the container which extends towards the inside of the cup, the best prerequisites for the separating of the cup are obtained. Hence, the corresponding forces of the collar act directly from above onto the annular step and therefore in the most stable plane of the cup. The abutment edge of the collar advantageously rests approximately in alignment with the annular step of the wall of the cup. The upper section of larger cross section of the cup serves in this connection as a guide surface for the collar. Different loads can therefore not occur in the region of the intended break line.

It is furthermore advantageous for the cup to be developed in conical shape, at least below its annular step. With an annular step which lies at about the center of the height of the cup an advantageous telescopability of the cup is obtained. This is favorable in particular, for storage and naturally also for holding in stock and shipment. Furthermore, the fact that the cylindrical surface of the collar is sealed off by a bead lying close to the abutment edge of the collar towards the inner surface of the cylindrical wall of the cup in a basic sales position is also favorable for the assembly of the device. The sealing of the component located in the cup is achieved by simple means, namely by the annular step (A) lying underneath the bead (14) which engages against the cylindrical surface of the collar (9), the bead projecting inwardly from the inner surface of the cup wall (W). In this way the initial region of the cup can be easily moved through by the collar, and the sealing action occurs only at the last moment. The compression within the inside of the cup which then takes place is only slight and practically without effect.

The cup itself is securely held within the neck. One embodiment which is advantageous in this respect is characterized by the fact that the cylindrical wall of the cup is held in the neck of the package by a clip step which lies near the mouth of the neck of the package and that the outer surface of the cylindrical wall of the cup below the clip step is spaced from the inner surface of the neck of the package. The space present there results in advantageous radial flexibility, which favors the seal between collar and cup. On the other hand, the location of the clip step as close as possible to the mouth produces, in this case also, the advantageous effect of the sealing closure only during the last moment of the attachement to the cup.

The screw cap itself is also held in clip attachment on the package. In this respect, the screw cap, in its basic sales position, engages behind a clip shoulder on the neck, while the bottom-most region of the screw thread is formed of individual thread projections which lie, with interruption, one behind the other in the circumferential direction. This interrupted pre-thread makes it possible to simply press the cap on, the thread projections being jumped over by the internal thread of the screw cap until the clip position is reached. The unilateral support of the flank of the thread which is established already by the pre-thread favors the tilt-free further screwing-on of the cap. The projections may advantageously be of lenticular shape and of different height. This measure additionally favors the pressing on of the screw cap. In the basic sales position which is thereby reached, the abutment edge of the collar is still spaced from the annular step. Intentional further screwing, overcoming the frictional forces at the sealing bead, is thereupon still necessary in order to enter into the intermediate position which permits the tearing off of the lower section of the cup.

It is advantageous for reasons of manufacture for the clip step and the clip shoulder to be arranged approximately on the same cross sectional plane. In particular, upon the forming of the clip step from the material of the wall of the neck the material which is thereby displaced upward can be used to form the clip shoulder (simple displacement of material). Finally, another advantageous feature is that the annular step is formed by a bridge between two sections of the cylindrical wall of the cup which are spaced from each other in radial direction. The corresponding offset in the cylindrical wall can easily be produced by molding. In this connection, there is advantageously taken as a base an amount of offset which corresponds approximately to the thickness of the cylindrical wall. The height of the offset edges, one of which represents the annular step lying on the inside of the cup, determines the resistance to tearing of the bridge material.

BRIEF DESCRIPTION OF THE DRAWINGS

Further advantages and details of the object of the invention are explained in further detail below, with reference to an embodiment shown in the drawing, in which.

DETAILED DESCRIPTION OF THE PREFERRED EMBODIMENT

Figure 1:
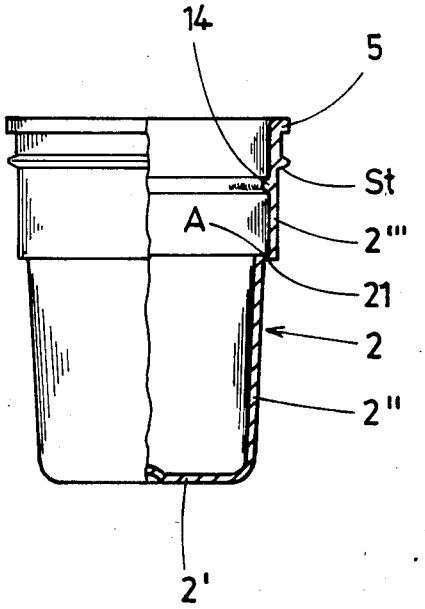
FIG. 1 is an individual showing of the cup, partially in elevation and partially in section.
Figure 2:
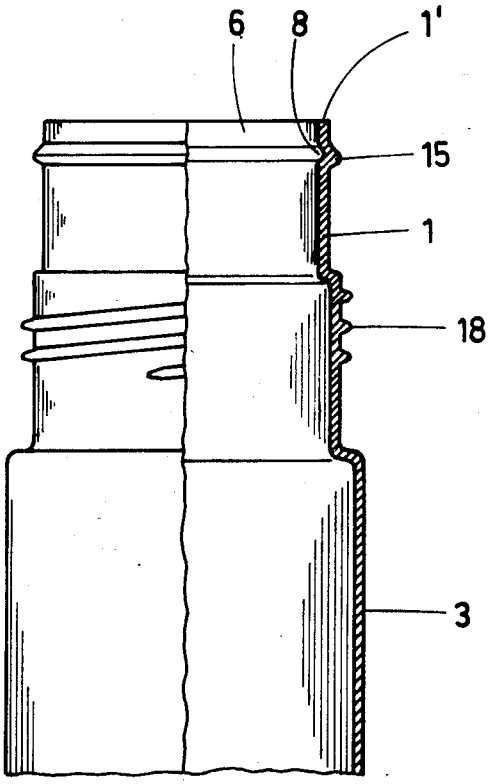
FIG. 2 shows the neck of the package, partially in elevation and partially in section.

The two-component package contains the one component I within a cup 2 contained with the package neck 1 and the other component II in the package 3 of larger volume.

In order to mix the two components, the cup 2 is torn off. As a separating tool there is used a screw cap 4 which simultaneously serves as a closure.

The cup 2, which consists of plastic, forms an outwardly directed rim 5 in its upper, substantially cylindrically shaped section. This rim extends over the corresponding end edge 1' of the package neck 1. The rim 5 does not protrude towards the outside and it defines the depth of the suspension of the cup 2. The latter, however, is also additionally secured against falling out. For this purpose, the cylindrical wall W of the cup is secured in the neck of the package by a clip step St which lies close to the mouth 6 of the neck 1 of the package. This clip step is formed by an annular rib 7 on the outer surface of the cylindrical wall W of the cup, said annular rib engaging in an annular groove 8 of corresponding shape on the inner surface of the neck 1 of the package.

Figure 7:
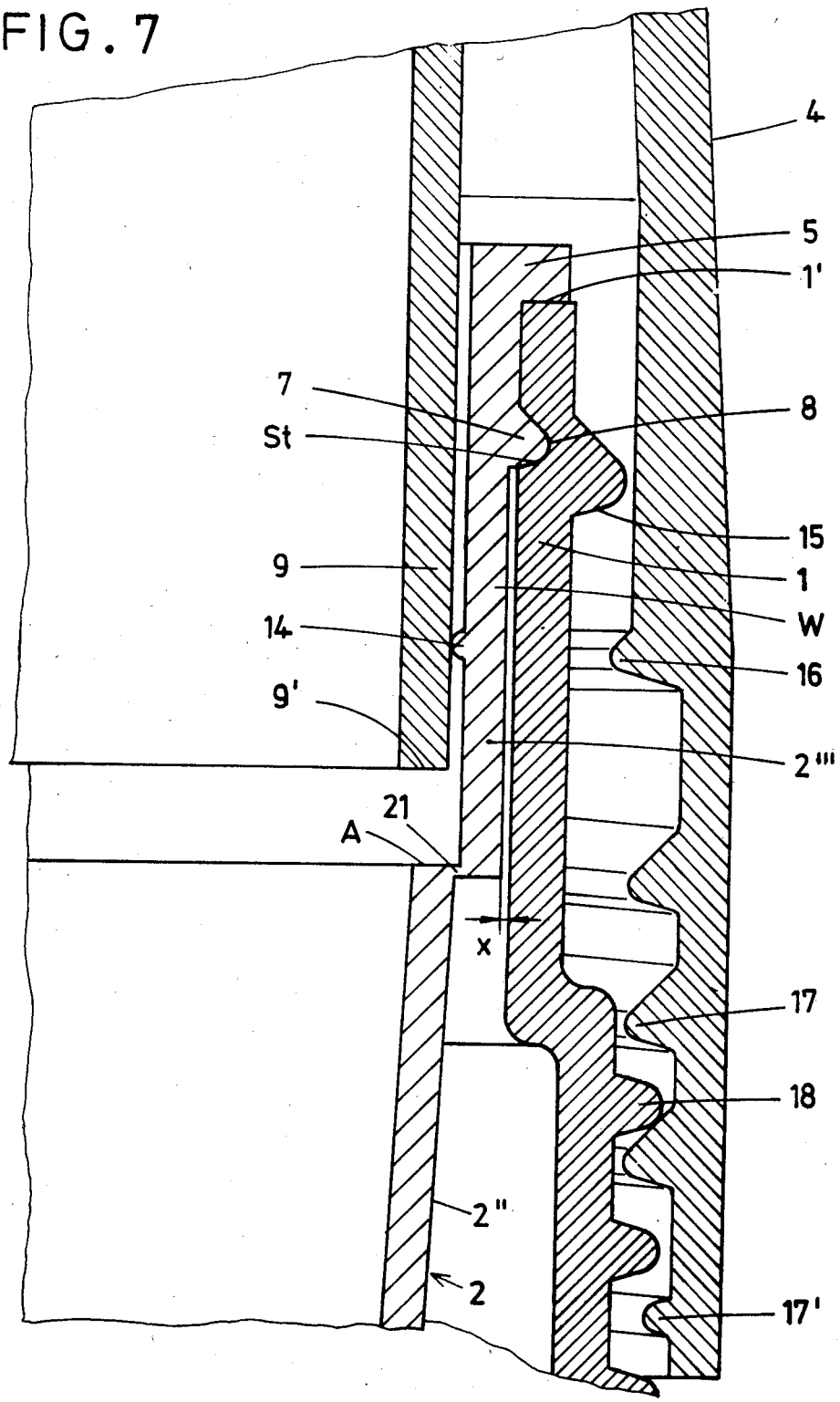
FIG. 7 is an enlarged view of a portion of FIG. 6, showing particularly clearly the clip step and clip shoulder as well as the sealing bead.
Figure 8:
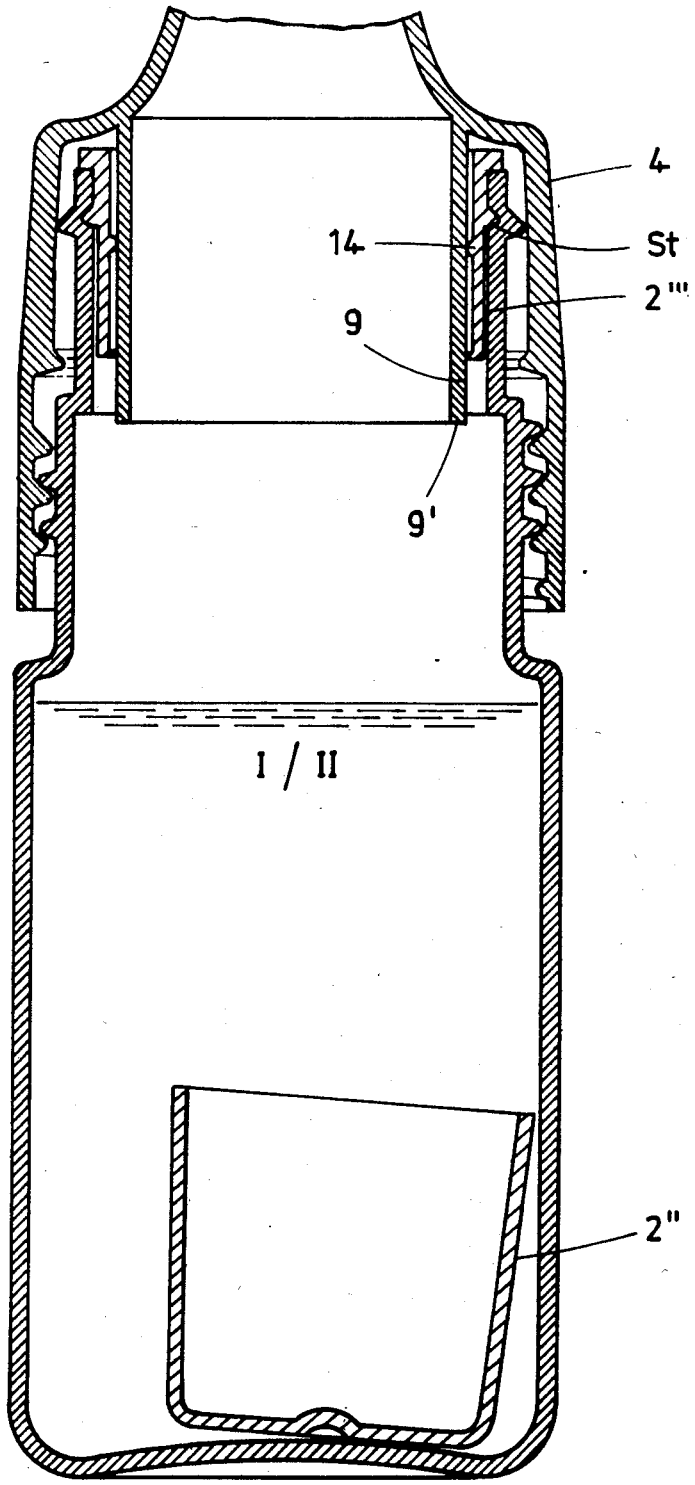
FIG. 8 is a sectional view corresponding to FIG. 6 but with the cup section torn off.

The outer surface of the cylindrical wall W of the cup extends, below the clip step St, at a distance x from the inner surface of the package neck 1 (see FIG. 7). In this way, the cup 2 can be conveniently introduced into the package. The sealing association is obtained only in the final moment of the insertion attachment, friction occurring between the annular rib 7 and the cylindrical inner surface of the package neck 1. Due to its closeness to the mouth 6, this region of increased friction is considerably reduced; nor is there any substantial compression within the package upon the introduction of the cup. Even slight compression would not be capable of pressing the cup out again. The clipping forces are correspondingly adapted.

The cup 2 which can be removed from the package after removal of the screw cap 4' is divided by an intended break line. This line is formed by an annular step A on the cylindrical wall W of the cup, which step A lies towards the inside of the cup and extends at a distance y from the bottom 2' of the cup. The abutment edge 9' of a collar 9 of the screw cap 4 which is introduced from above into the cup strikes against said annular step A. The collar commences in the screw-cap cover 10 and is developed as a cylindrical annular wall. The abutment edge extends perpendicular to the longitudinal central axis z-z of the two-component package, which is developed with rotational symmetry.

At its top, the collar 9 is extended by a dispensing tube 11 which tapers continuously to its free end. Its dispensing opening 12 is kept closed by a stopper 13 which is attached by molding. This is an original closure.

The abutment edge 9' of the collar is substantially on a line with the annular step A of the cylindrical wall W of the cup. The space y corresponds approximately to two-thirds of the height of the cup 2.

Figure 6:
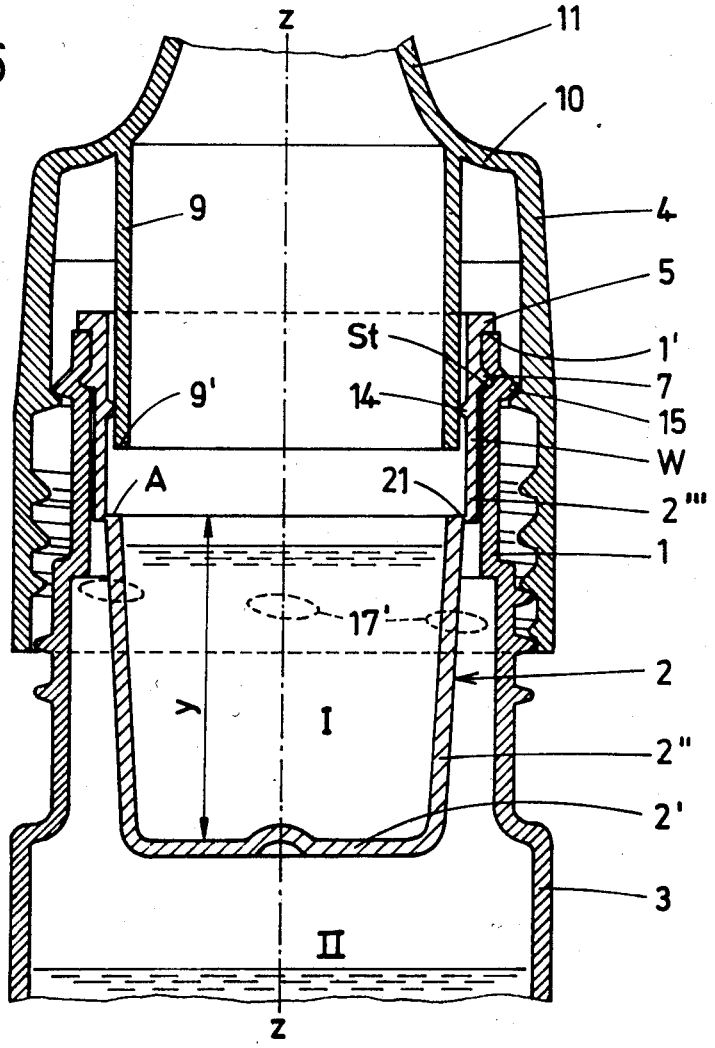
FIG. 6 is a vertical section in the region of the package neck of the two-component package, namely in the basic sales position, shown in a larger size than in the preceding figures.

In the basic sales position shown in FIG. 6, the abutment edge 9' of the collar 9 is spaced from the annular step A.

The outer vertical surface of the cylindrical collar 9 is sealed at the inner vertical surface of the cylindrical wall W of the cup in the basic sales position by a bead 14 which lies close to the collar abutment edge 9'. The bead 14, which is developed as an annular rib and is disposed parallel to the abutment edge 9', is formed on the interior of cup 2. The bead 14 lies, insofar as possible, at the height of the abutment edge 9' so that a frictional sealing closure will take place only at the last moment upon the attachment of the screw cap. In this manner, the trapping of air and creation of internal pressure can be minimized so that the screw cap 4 is not pushed off by the internal pressure which is formed during assembly.

In addition, a safety measure is also provided. This is achieved whereby the screw cap 4 engages, in the basic sales position, behind a clip shoulder 15 on the package neck 1. The clip shoulder 15 extends approximately on the same cross-sectional plane as the clip step St. The shoulder-forming section of the package wall is, substantially or partly comprised of the material displaced by the annular groove 8 on the inner surface of package neck 1. The mating shoulder 16 on the screw-cap side is an annular rib directed towards the inside of the cap.

Figure 9:
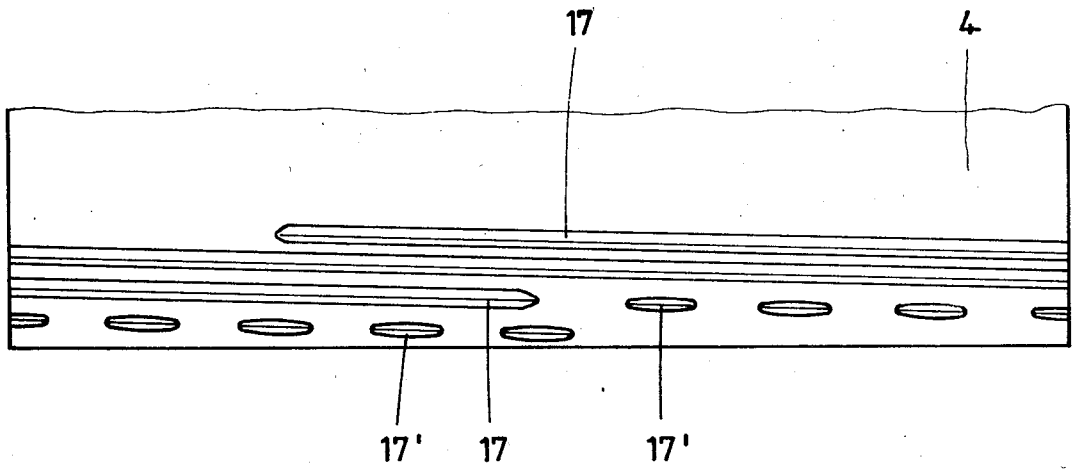
FIG. 9 is a developed view of the thread of the screw cap.

In the basic sales position defined by the clip shoulder 15 there is already thread engagement between the screw cap 4 and the package neck 1. The screw cap 4 is simply pushed on. As a result thereof, the lowermost region of the screw thread 17 of the cap 4 comes into engagement with the external thread 18 on the neck of the package. The external thread 18 is seated on a somewhat widened lower section of the package neck 1. In order to facilitate the attachment of the screw cap and package neck, this lowermost region of the thread consists of individual thread projections 17' lying, with interruption, one behind the other in the circumferential direction, as seen in FIG. 9. These projections form a sort of auxiliary thread or pre-thread, which extends over a circumferential region of 360 degrees. The full thread then starts. The individual thread projections 17' are approximately of lenticular shape. The lenticular shape results in convex roundings both in the direction of rotation of the screw-cap 4 and in the transverse direction thereof (direction of the pushing-on of the cap). The distance between them corresponds approximately to the length of one projection. A total of eight projections extend over the periphery. They are disposed at different height so that passage over the external thread 18 is facilitated upon the pushing or screwing of the cap. This arrangement facilitates tilt-free screwing on of the screw cap 4.

Figure 3:
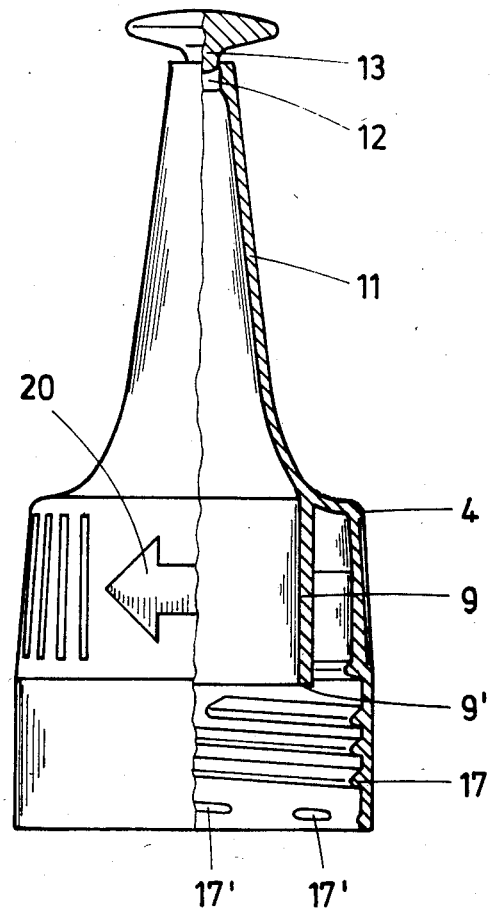
FIG. 3 shows the corresponding screw cap by itself, partially broken away.
Figure 4:
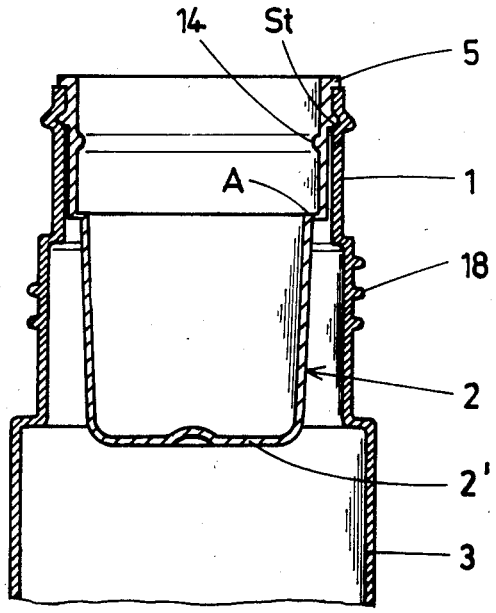
FIG. 4 is a sectional view through the neck of the package with the cup attached.
Figure 5:
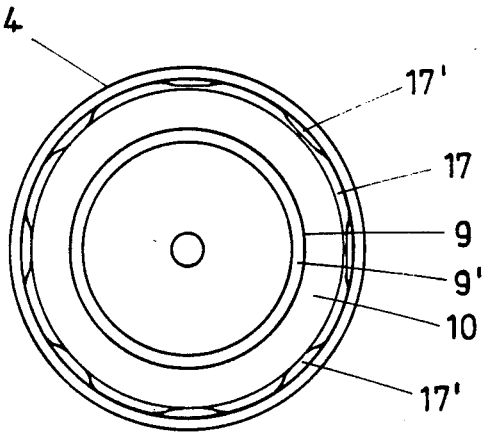
FIG. 5 is a bottom view of the screw cap indicating the projections which form an auxiliary thread.

The filling of the two-component package is effected as follows:

First of all, the package 3 of larger volume is filled with component II. The height of filling takes into account the depth of insertion of the cup 2. The latter is introduced into the neck of the package in the manner described. The cup 2 is filled with component I. Thereupon, the screw cap 4, which acts as closure element and tool, is applied. The basic sales position results, due to the clip shoulder 15 which is moved over by the mating shoulder 16 of the screw cap. The flank on the mouth side is correspondingly beveled while the lower flank of the clip shoulder 15 is substantially steeper. At this stage the lowermost region formed by the thread projections 17' of the screw thread 17 is in engagement with the external thread 18. Only upon further turning of the screw cap 4 in the direction indicated by the arrow 20 (see FIG. 3) does the abutment edge 9' of the collar approach the annular step A of the cylindrical wall W of the cup. The thread engagement between screw cap 4 and package neck 1 is of such length that the lower portion 2'' of the cup 2 is separated upon from the upper portion 2''' the further screwing of cap 4. Hence the bridge of material 21, which is in the nature of a film hinge, is torn between the two sections 2'' and 2''' of the cylindrical wall W of the cup which sections are spaced apart from each other in radial direction. The separated portion 2'' of the cup drops into the package 3. The two components can now be mixed by shaking. In this case the container lower portion 2'' which has been torn off serves at the same time as shaking-/mixing member. The tight seal between the collar 9 and the cup upper portion 2''', which now only represents a sealing member, is fully maintained during the shaking.

For the dispensing of the mixture it is then merely necessary to remove the stopper 13.

The offset of the wall sections 2'' and 2''' with respect to each other corresponds approximately to slightly more than the thickness of the cylindrical wall W of the cup. The two sections of the cylindrical wall overlap in the region of the bridge of material 21. The amount of the overlap corresponds approximately to one-fifth of the thickness of the cylinerical wall. The cup 2 is of frustoconical shape below the annular step A.

We claim:

1. In a two-component package having a cup arranged in a neck of the package to receive one component, and a screw cap, said cup defining an intended break line thereon, said cap cooperating with the neck of the package and having a collar which extends into the cup, said collar defining an abutment edge at the front end thereof, said cup cooperating with said cap in a basic sales position, said abutment edge disposed for separating the cup in the region of said break line upon a screwing of the cap beyond the basic sales position, the improvement comprising said cup defines a cup wall, said wall having an annular step defined therein, said step defining said break line spaced above the bottom of said cup, said abutment edge of said collar being aligned with said annular step, an inner surface of said cup wall has a bead inwardly directed therefrom, said bead disposed above said annular step engaging against an outer surface of said collar.

2. The two-component package according to claim 1, wherein said cup has a frustoconical shape, at least below the annular step.

3. The two-component package according to claim 1, wherein said package neck comprises a clip step, which clip step lies close to the mouth of said package neck, said cup wall being secured in said package neck by said clip step, the outer surface of the cup wall being arranged below the clip step at a distance from the inner surface of said package neck.

4. The two-component package according to claim 1, wherein said package neck comprises a clip shoulder, said cap engaging behind said clip shoulder in the basic sales position, said cap being internally threaded wherein the lowermost lying region of said threads comprises individual thread projections, said projections located, with interruption, one behind the other in the circumferential direction.

5. The two-component package according to claim 4, wherein said thread projections are of lenticular shape.

6. The two-component package according to claim 5, wherein adjacent ones of said thread projections are disposed on the interior of said cap at different heights.

7. The two-component package according to claim 1, wherein said abutment edge is located at a distance above the annular step in the basic sales position.

8. The two-component package according to claim 6, wherein said package neck comprises a clip step, which clip step lies close to the mouth of said package neck, said cup wall being secured in said package neck by said clip step, the outer surface of the cup wall being arranged below the clip step at a distance from the inner surface of said package neck, wherein said clip step and said clip shoulder are arranged approximately in the same cross-sectional plane.

9. The two-component package according to claim 1, wherein said cup wall comprises two sections, said annular step being formed by a bridge between said two sections, which sections are spaced apart from each other in radial direction.

10. The two-component package according to claim 1, wherein said collar is substantially cylindrical in cross section.

11. The two-component package according to claim 10, wherein said cap further comprises a dispensing tube which tapers continuously to a free end thereof, said collar extended by said tube, said tube comprising an integral stopper attached by molding to said tube for closure of said tube.

12. The two-component package according to claim 1, wherein said outer surface of said collar is sealed by said bead engaging thereagainst adjacent said abutment edge of said collar in said basic sales position.

13. The two-component package according to claim 1, wherein said outer surface of said collar is cylindrical.

* * * * *